US005820676A

United States Patent [19]

Bauerle

[11] Patent Number: 5,820,676

[45] Date of Patent: Oct. 13, 1998

[54] APPARATUS FOR PAINTING ELONGATED THIN SHAFTS

[76] Inventor: Albrecht B. Bauerle, 1024 Old Mountain View Rd., El Cajon, Calif. 92021

[21] Appl. No.: 526,447

[22] Filed: Sep. 11, 1995

[51] Int. Cl.[6] ..... B05C 3/02

[52] U.S. Cl. ..... 118/421; 118/404; 118/407; 118/413; 118/421; 118/423; 118/500; 118/DIG. 11; 118/DIG. 12

[58] Field of Search ..... 118/DIG. 11, DIG. 12, 118/DIG. 13, DIG. 19, 423, 404, 407, 413, 421, 500

[56] References Cited

U.S. PATENT DOCUMENTS 1,949,234 2/1934 Baxter ..... 118/404
5,284,229 2/1994 Logan et al. ..... 118/107

*Primary Examiner*—Donald E. Czaja
*Assistant Examiner*—Steven B. Leavitt
*Attorney, Agent, or Firm*—Gilliam, Duncan & Harms

[57] ABSTRACT

An apparatus for applying precise, uniform, coatings to elongated shafts, such as golf club shafts. Shafts are held by a gripper in a downwardly hanging array. A paint head assembly is moved upwardly over each shaft in sequence to apply a paint coating to a selected portion of the shaft length. The paint head assembly includes a flexible container including a central hole, a vertically moveable edge frame and an expander for changing the area of the hole. Raising the frame forms the container into a bowl like configuration, so that paint will contact a shaft extending through, and in contact with, the hole. The assembly is moved up along the shaft to apply a layer of paint, with the hole area varied to accommodate shaft taper, steps, etc. When the desired shaft length has been painted, the frame is lowered, changing the container to a trough-like configuration with pint away from the hole region. The expander widens the hole out of contact with the shaft and the assembly is lowered to below the shaft end. The sequence repeats with the next shaft. Mechanisms for intermittently moving shafts into and out of the painting location and for continuously agitating paint in the container are included.

16 Claims, 5 Drawing Sheets

APPARATUS FOR PAINTING ELONGATED THIN SHAFTS

BACKGROUND OF THE INVENTION

This invention relates in general to painting apparatus and, more specifically, to apparatus for painting elongated thin shafts such as golf club shafts.

A wide variety of methods and apparatus have been developed for applying paint to surfaces, including brushes, rollers, spray guns, etc. Each of these has advantages in applying particular types of coatings to specifically configured surfaces.

Thin shafts may be tapered, have varying tapers or "steps" between sections of different diameter and may have various cross sections, typically round, square, rectangular, or other polygonal sections. Often, the ends must be left unpainted, such as in the case of a golf club where one end fits a club head hosel and the other end is to be covered with grip material.

Coating of thin shafts, such as golf club shafts must produce a very uniform, very high quality, visually appealing coating. Irregular painting may produce imbalance and irregular weight characteristics, which may have an adverse effect on flex characteristics with ultra light shafts. Purchasers will examine the coated surface closely and reject poorly coated products or those showing coating color variations.

Where paint or similar coatings are to be applied to elongated thin shafts such as golf club shafts, in particular where the shafts are tapered over their lengths, conventional painting techniques are not effective. Painting with brushes or rollers requires considerable skill, is time consuming and is likely to result in uneven coatings with streaks, brush marks, runs and other irregularities. Spraying also requires considerable skill to produce an even coating without runs or uneven areas. In addition, where the shaft is quite narrow, much of the coating material is wasted as overspray passes by the object being painted.

Prior painting techniques are slow and not well adapted to producing highest quality coatings on a rapid, production line, basis.

Thus, there is a continuing need for improved methods and apparatus for coating thin shafts such as golf club shafts that will rapidly produce a very high quality coating on a production line basis, free from visible defects while using a minimum of the coating material and which can accommodate shafts having a variety of cross sections and which may have varying tapers, taper variation steps, etc.

SUMMARY OF THE INVENTION

The above-noted problems, and others, are overcome by a painting apparatus for coating thin elongated shafts which basically comprises a device for holding a proximal end of a shaft in a vertically downwadly extending position, a paint head assembly positioned beyond the distal shaft end, means for moving the paint head upwardly along the shaft and a paint application assembly within the paint head for wiping a uniform coating of paint or other coating liquid onto a selected part of the shaft length as the head moves upwardly, then moving the wiping mechanism out of contact with the shaft and lowering the painting head so that the coated shaft can be replaced with the next shaft to be coated.

The pressure applied by the wiper assembly, together with the speed of movement of the paint head govern the thickness of the coating applied. Slower movement and/or greater pressure will wipe more paint away, resulting in a thinner coating. The pressure of the wiper means must be variable to accommodate taper or other changes in shaft diameter, such as varying taper, steps between tapered lengths, etc.

The paint head basically comprises a flexible, rubber or plastic sheet, having a central hole and an outer edge held in a frame movable between raised and lowered positions. An expander means is fastened to the sheet around the central hole. The expander means is movable between a relaxed position in which the opening is smaller in area than the cross sectional area of the shaft to be painted and an expanded position in which the opening is larger in area than that of the shaft. Under predetermined computer control, the size of the opening and the resulting wiping pressure can be continuously controlled during paint head movement (together with paint head movement speed) to apply a very uniform paint layer over a shaft that varies in diameter.

In operation, initially the paint assembly is in the lower position with the expander relaxed and the frame lowered, so that the flexible sheet forms a circular trough-like configuration around the central hole. The trough is filled with paint to a level below the level of the outer edge and central hole. A shaft is positioned vertically over the assembly, with the distal end of the shaft adjacent to the hole. The expander increases the hole area to larger than the diameter of the shaft.

The assembly is moved upwardly until the hole is located along the shaft at the position at which painting is to begin. The expander decreases the hole size to bring the edges of the hole into contact with the shaft and give the selected wiping pressure. The frame is then raised to elevate the outer edge of the sheet, so that the sheet assumes a bowl-like configuration, with the hole and portion of the shaft just above the hole now below the level of the paint.

The paint head is then moved upwardly along the shaft, with the hole edges wiping a thin, uniform layer of paint onto the shaft. Wiper pressure and paint head speed are varied so that a uniform paint layer is applied as shaft diameter varies. When the shaft level at which the painting should end is reached; that is, when the surface of the paint reaches that level, the frame is gradually lowered, so that the sheet reassumes the trough-like configuration with the paint away from the shaft, and the wiper continues to move to the stop level to finish the proper paint thickness to the stop line. The expander then expands the hole out of contact with the shaft.

The painting assembly is lowered to a position below the shaft and the now-painted shaft is removed and another shaft to be painted is brought into position. The above described steps are repeated with the next shaft.

The paint application assembly is typically moved upwardly and downwardly by a lead screw drive system, with the assembly guided by linear bearings moving along plural parallel shafts. In a preferred embodiment, a rotary indexing head having at least two shaft end gripping means is provided for holding the shafts. The indexing head rotates about a horizontal axis, so that when painting of one shaft is completed that shaft can be rotated to a removal and replacement position while a second shaft is rotated into the painting position. The completed shaft is removed and replaced with a new unpainted shaft.

For the purposes of this application, paint should be understood to include any surface coating material or any other treatment of a surface with a liquid which desirably is applied with a uniform, precise thickness, layer. While this application is particularly useful with round tubular shafts, which may be tapered and/or stepped, of the sort used in golf clubs, any other shafts, solid or tubular, having any cross-sectional configuration, such as elliptical, square, triangular, etc. may be painted with this apparatus.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
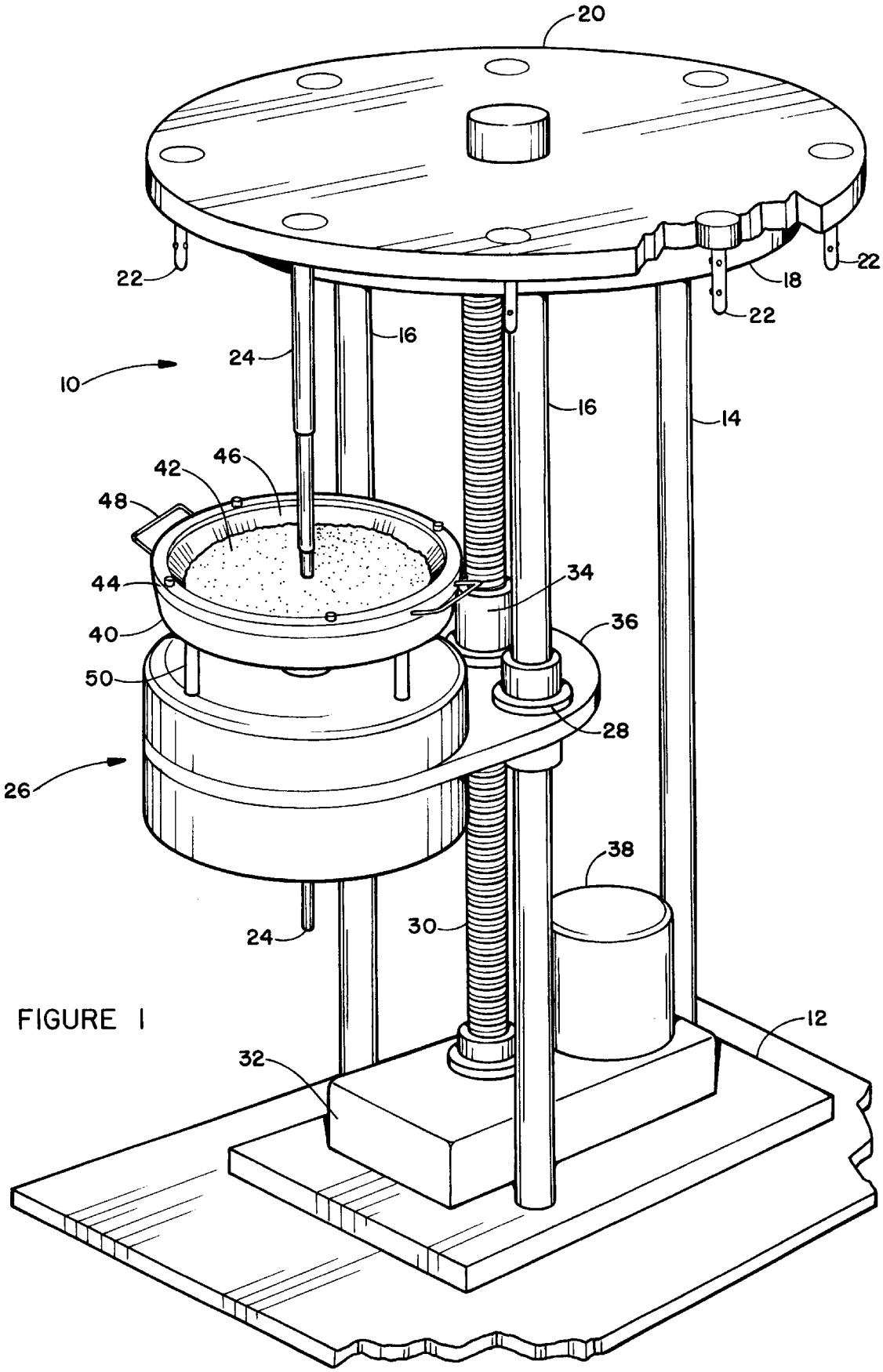
FIG. 1 is a perspective view of the overall shaft painting apparatus of this invention.

Referring to FIG. 1, there is seen the overall shaft painting machine 10 including a base plate 12, one (or more, if desired) upright back column 14 and two (or more, if desired) forward columns 16, mounted on base plate 12 and supporting top plate 18.

Figure 7:
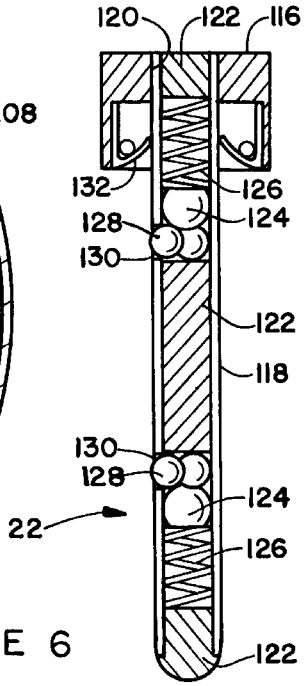
FIG. 7 is a detail axial section view through the shaft holder mechanism.

Attached to top plate 18 is an indexing mechanism between top plate 18 and rotatable disk 20 (as shown in detail in FIGS. 12 and 13 and described below) carrying a plurality of shaft gripping means 22, detailed in FIG. 7, each of which is inserted into and grips one tubular shaft 24.

Any suitable number of gripping means 22 may be used.

Painted shafts are removed and unpainted shafts are mounted at one location. A large number of gripping means, such as the eight shown, is preferred so that the paint may harden between the painting location and the removal location.

Figure 2:
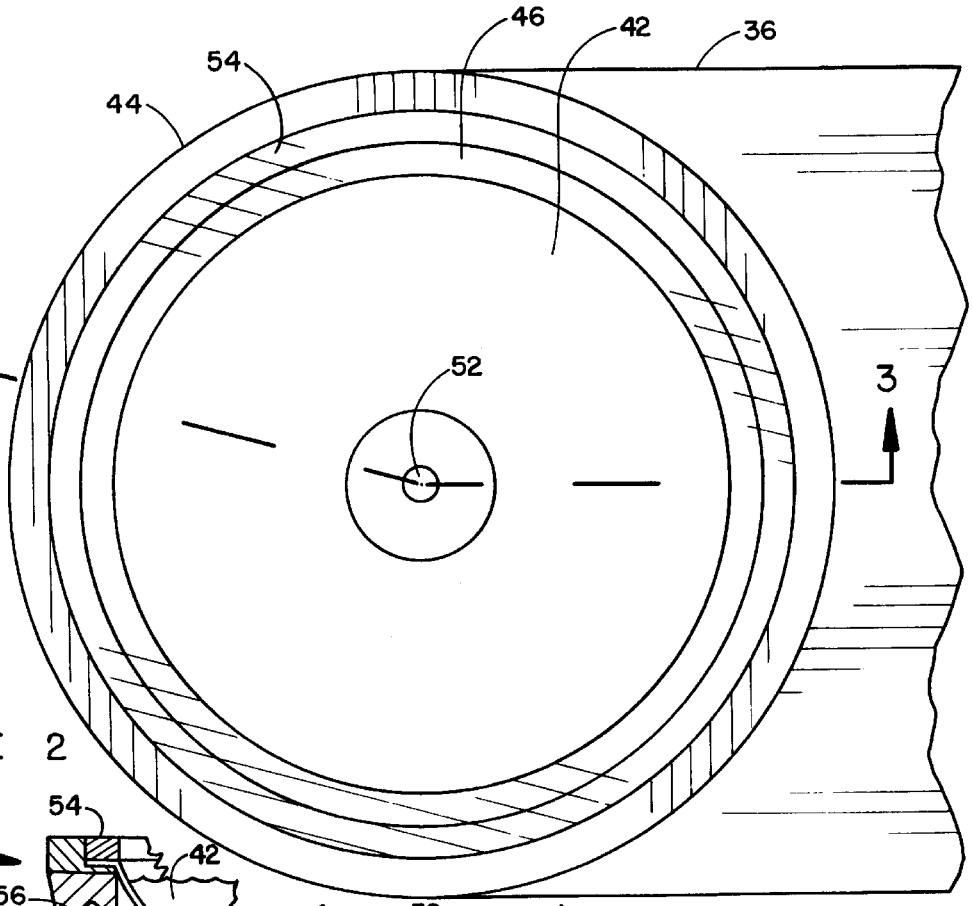
FIG. 2 is a plan view of the paint head portion of the painting apparatus.

A paint head assembly 26 is mounted for movement along columns 16 by linear bearings 28 (as seen in FIG. 2). A lead screw drive system includes a lead screw 30 extending between top plate 18 and a gear box 32 mounted on base plate 12, a traveling internally threaded tube 34 is secured to paint head support plate 36 and engages lead screw 30 to move paint head assembly 26 upwardly and downwardly. Lead screw 30 is rotated by a drive motor 38 through conventional gears (not shown) in gear box 32. Paint head plate 36 is supported and guided by linear bearings 28 secured to the plate and riding along forward columns 16.

FIG. 1 illustrates the machine 10 during the shaft painting operation, with paint head 26 moving upwardly along a shaft 24, typically a golf club shaft. Paint container 40 is in the painting configuration, with paint 42 in contact with shaft 24, applying a uniform layer of paint as detailed below. Container 40 includes a ring-like frame 44 supporting the outer edge of a circular flexible sheet 46 which has a central opening thorough which shaft 24 extends. Handles 48 are provided for removing and replacing container 40, which is removably mounted on vertical posts 50.

Paint head assembly 26 is detailed in FIGS. 2–6. The three major sub-combinations in assembly 26 are a mechanism for raising and lowering paint container 40, an expander mechanism for increasing and decreasing the diameter of central hole 52 in sheet 46 and a mechanism for stirring the paint.

Paint container 40 includes frame 44 having a rabbet into which the outer edge of circular sheet 46 fits and is held by ring 54 by screws or the like. Holes 56 spaced around frame 44 slidingly receive the upper ends of posts 50 so that container 40 can be easily removed. Posts 50 can be raised and lowered to raise and lower frame 44 so as to move sheet 46 between the two different configurations described below.

Figure 3:
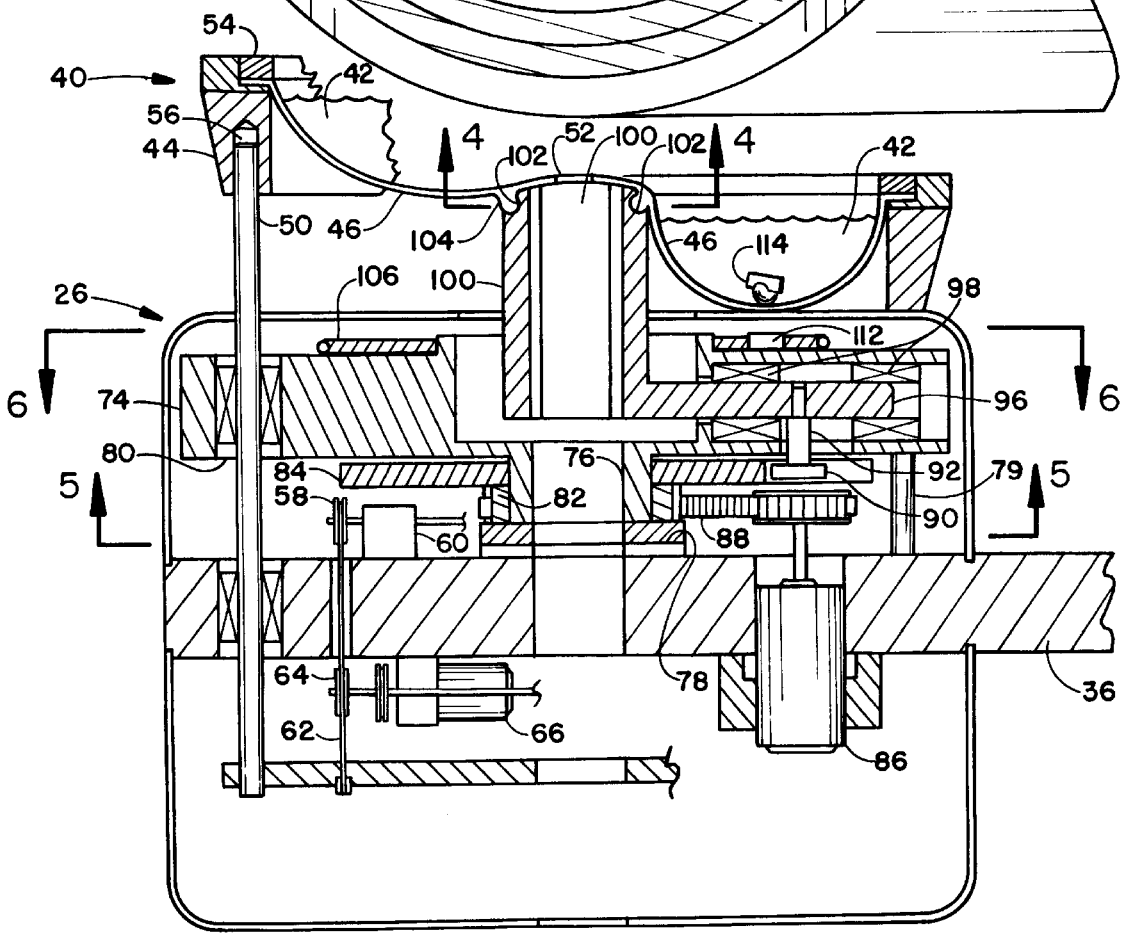
FIG. 3 is a section view, taken approximately along line 3—3 in FIG. 2.
Figure 8:
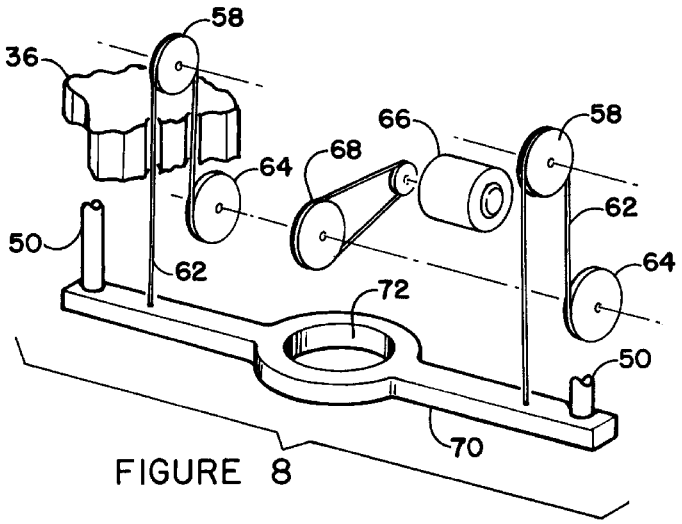
FIG. 8 is a schematic detail perspective view showing of the paint head frame elevating mechanism.

While any suitable raising and lowering mechanism may be used, that illustrated in FIGS. 3 and 8 is preferred. Pulleys 58 are mounted via pillow blocks 60 on the upper surface of paint head plate 36. Belts 62 extend from drive pulleys 64 driven by a motor 66 via a speed reduction system 68. One end of each belt 62 is secured to a drive pulley 64 with the opposite belt end secured to a crosspiece 70 on which two or more posts 50 are mounted. A central aperture 72 is provided for passage the lower end of a shaft 24 being painted. Two posts 50 are provided at the ends crosspiece 70.

FIG. 3 shows frame 44 raised at the left side and lowered at the right side, for clarity of illustration. When frame 44 is raised, the sheet 46 will be in a conical or overall bowl shape, with paint extending across the sheet center. When frame 44 is lowered, sheet 46 will form a circular trough configuration as seen at the right side of FIG. 3, with paint away from the center of the assembly 40.

Figure 4:
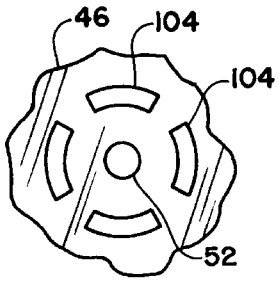
FIG. 4 is a detail section view, taken along line 4—4 in FIG. 3.
Figure 5:
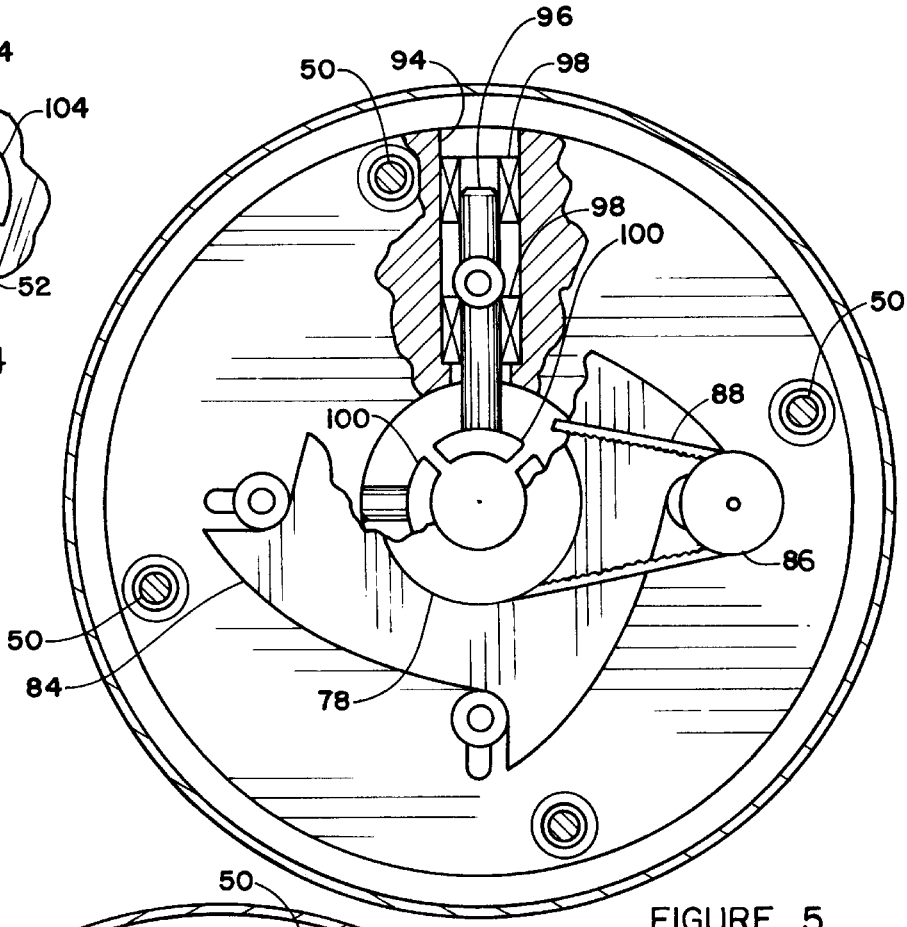
FIG. 5 is a section view taken along line 5—5 in FIG. 3.

A mechanism for varying the diameter of central hole 52 in sheet 46 is provided so that the diameter can be varied to provide a selected pressure around a shaft 24 extending through hole 52 and to maintain a uniform pressure as a tapered or stepped shaft is moved vertically through the hole. This mechanism is best seen in FIGS. 3–5.

A circular expander support plate 74 lies parallel to paint head plate 36 and is mounted thereon by four stand-offs 76 and end disk 78. Posts 50 extend through linear bearings 80. A pulley 82 is rotatably positioned around collar 76 and is secured to cam plate 84 for joint rotation. A servo drive motor 86 drives pulley 82 through belt 88 to rotate cam plate 84 very precise distances in either direction between preset limits. Cam followers 90 ride against the cam surfaces of cam plate 84. Each cam follower is mounted on a post 92 slidable in a radial slot in plate 74.

Radial holes 94 (as best seen in the cut away area in FIG. 5) house shafts 96 slidable in linear bearings 98. The inner ends of each shaft 96 is secured to one of the vertically extending tube segments 100. Thus, as cam plate is rotated slightly in either direction, each cam follower 90 through its post 92 will move the corresponding shaft 96 and associated tube segment 100 inwardly or outwardly, shrinking or expanding the diameter of the tube formed by all four tube segments.

At the upper end of the set of tube segments 100 a circular groove 102 is formed, as seen in FIG. 3. A corresponding circular protuberance 104 is formed in the undersurface of sheet 46, so that the protuberance tightly fits groove 102. As seen in FIG. 4, the protuberances may be in the form of circular segments corresponding to grooves 102. Thus, as tube segments 100 move outwardly from the innermost position, the central portion of sheet 46 will stretch, expanding hole 52. As discussed in conjunction with FIGS. 9–11, hole 52 will be set at an appropriate diameter for proper pressure contact against a shaft 24 during painting and can be expanded out of contact with the shaft 24 during insertion and removal of the shaft prior to and after painting.

Figure 6:
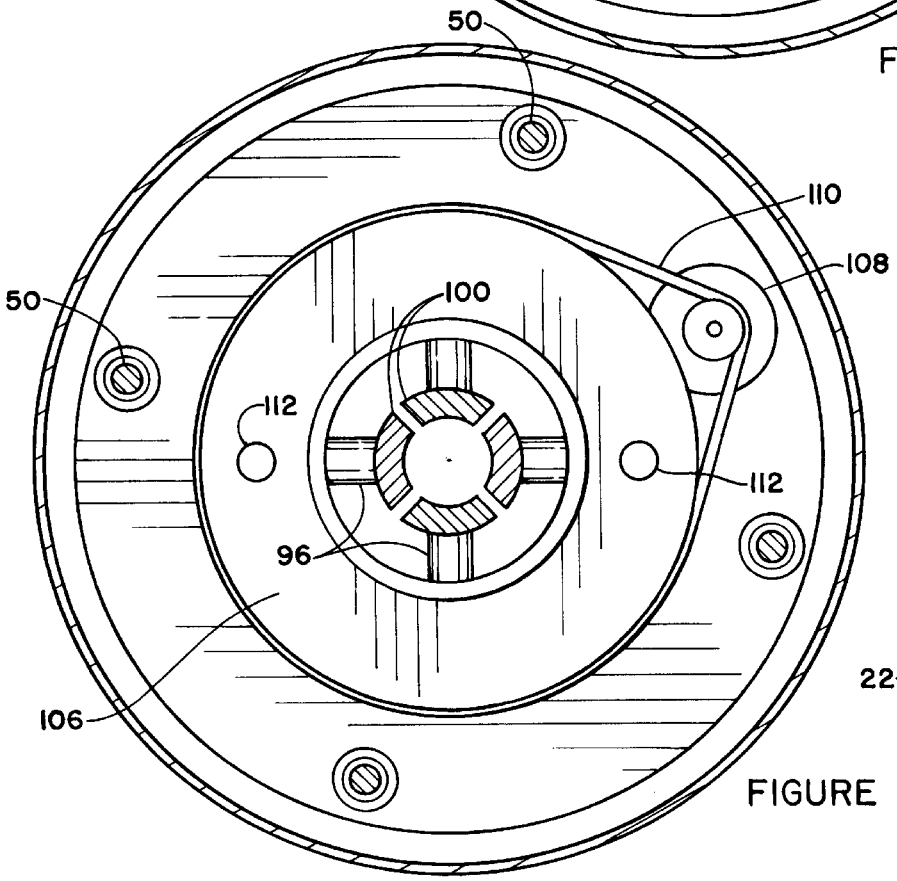
FIG. 6 is a section view taken along line 6—6 in FIG. 3.

In order to assure complete mixing of the paint and a uniform suspension, an agitation disk 106 is preferably rotatably mounted on the upper surface of expander support plate 74, as shown in FIGS. 3 and 6. Disk 106 is rotated by motor 108 through belt 110. Two (or more, if desired) small magnets 112 are imbedded in disk 106, which should be of a non-magnetic material such as aluminum. At least one irregular object 114 of magnetic material is placed in paint 42. As the magnets 112 move along just below sheet 46 when in the trough-like configuration (during the wait between painting operations), objects will move and bounce through the paint, assuring complete dispersion and preventing settling.

FIG. 7 illustrates, in axially section, a preferred mechanism for releasably securing tubular shafts to be painted during the painting and paint drying steps.

A plurality of shaft grippers 22 are vertically mounted in holes evenly spaced around the periphery of disk 20, as seen in FIG. 1. Each gripper, as seen in FIG. 7, includes a head 116 for mounting in disk 20, secured by any suitable means such as adhesives, set screws, threads, or the like. A tube 118 is mounted in a hole 120 in head 116 and has spaced top, center and bottom plugs 122 secured therein. Tube 118 is sized to slidably fit within a tubular shaft 24 to be painted. Between each spaced pair of plugs 122 is provided a ball 124 (typically a conventional ball bearing ball) sized to be slidable within the tube and biased by a spring 126 in an upward or downward direction. Three smaller balls 128 are provided between a ball 124 and an adjacent plug 122. Holes 130 through tube 118 having diameters less than the diameters of balls 128 are provided adjacent to each ball 128, so that pressure of springs 126 against large balls 124 will cause small balls 128 to be biased outwardly partially through holes 130. Thus, when a tubular shaft 24, typically a golf club shaft, is pushed over tube 118, small balls 128 will be pushed back into tube 118 but will engage and hold the tube in place. In order to further hold shaft 24 in place and assure that the shaft 24 is vertical, a circular spring 132 is included within head 116 and bears against the upper sidewall of a shaft 24. This assembly securely holds a shaft 24 in place during painting while allow easy mounting of shafts to be painted and removal of completed shafts. Any other suitable gripping means may be used where the shafts to be painted are not tubular.

Figure 9:
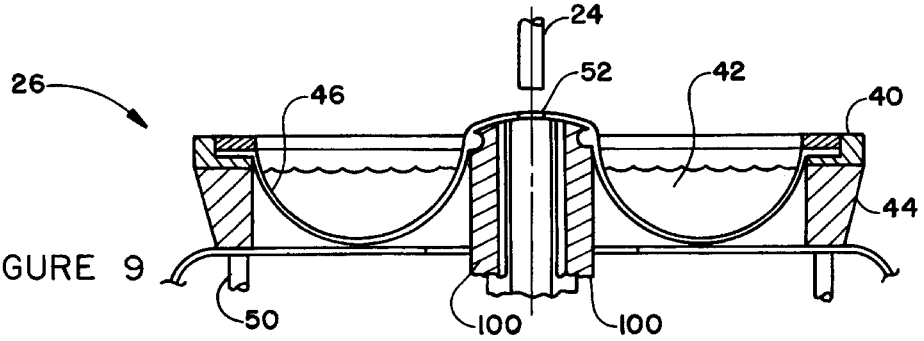
FIG. 9 is a schematic vertical axial section view through the paint head in the at rest position.
Figure 11:
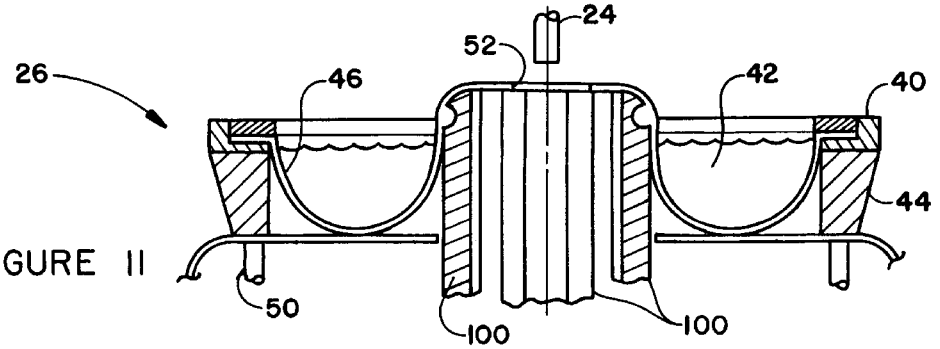
FIG. 11 is a schematic vertical axial section view through the paint head in the loading position.
Figure 10:
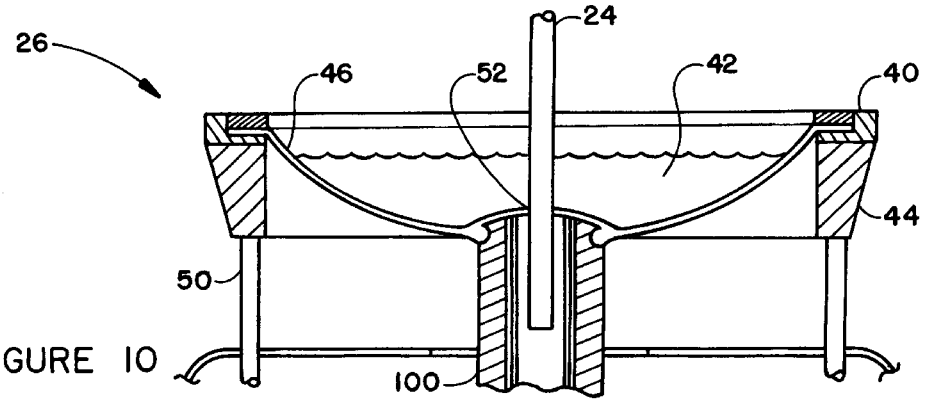
FIG. 10 is a schematic vertical axial section view through the paint head in the painting position.

FIGS. 9–11 schematically illustrate three positions of the expander tube segments 100 and hole 52.

In the initial position, as seen in FIG. 9, paint head assembly 26 is fully lowered and a tubular shaft 24 to be painted is mounted above the assembly. Frame 44 is lowered, so that sheet 46 assumes the circular trough configuration, holding paint 42 away from hole 52. Expander tube segments 100 are moved apart to expand hole 52 out of contact with shaft 14. Paint head assembly is then raised so that the end of shaft 24 extends through hole 52 and the expander segments are positioned, under conventional microprocessor control, so that the edges of hole 52 apply the proper pressure against shaft to produce a selected paint layer thickness on the shaft.

Painting is accomplished as shown in FIG. 10. With hole 52 at the level where painting is to begin, posts 50 are raised, raising frame 44, so that sheet 46 assumes an overall bowl-like configuration with paint in contact with shaft 24. Paint head assembly 26 is then raised to apply paint over the desired length of shaft 24. As the assembly 26 moves up, expander segments 100 may be moved outwardly as necessary to expand hole 52 to accommodate taper or steps along shaft 24. While these precise variations in diameter of hole 52 can be preset, preferably they are under conventional microprocessor control. The microprocessor may be conventionally programed with the shaft profile, or a sensor positioned ahead of the paint head could measure shaft diameter and control the expanding means. When the paint surface reaches the point at which the paint coating should end, upward movement of assembly 26 is stopped. Since paint level within paint container 40 will gradually drop as paint is used, and will rise when replenishment paint is added, in order to provide an accurate, consistent location for the paint start and end lines, the microprocessor may vary the start and stop levels to accommodate empirical paint use and replenishment rates, or any conventional paint level sensor may be used to measure paint level and control the start and stop lines.

As seen in FIG. 11, when the paint head assembly 26 has completed the painting cycle, posts 50 are retracted, lowering frame 44 so that paint container 40 reassumes the circular trough-like configuration. Expander segment 100 are expanded to expand hole 52 to the point where the hole edges are well spaced from shaft 24, as shown. Then, paint head assembly can be lowered to the start position without any contact with the painted shaft. As described below, the painted shaft 24 is cycled through a paint drying period and the next shaft is painted.

Figure 12:
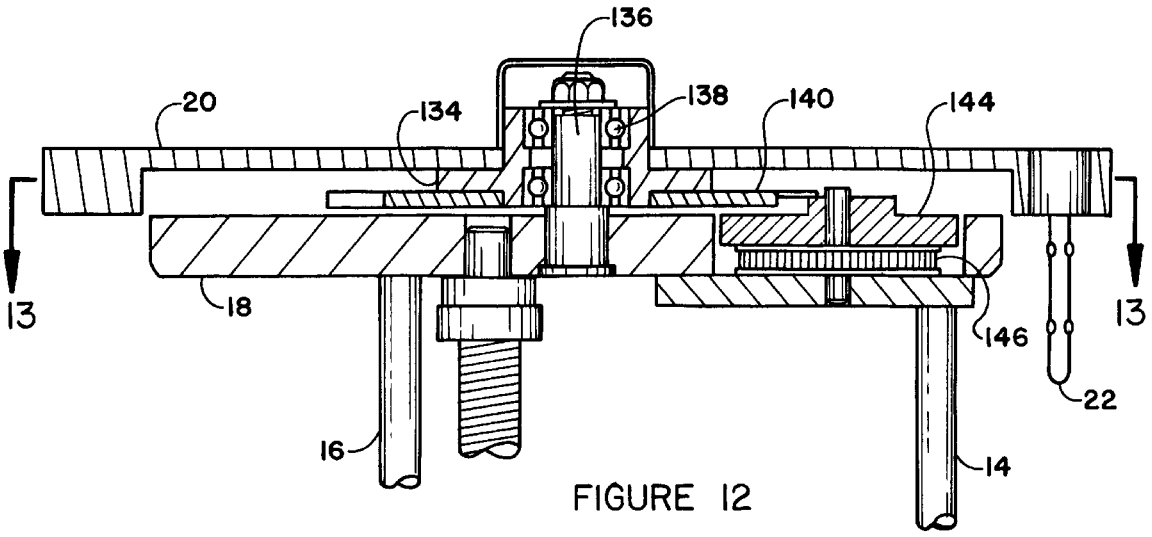
FIG. 12 is a section view of the indexing mechanism, taken on line 12—12 in FIG. 13.
Figure 13:
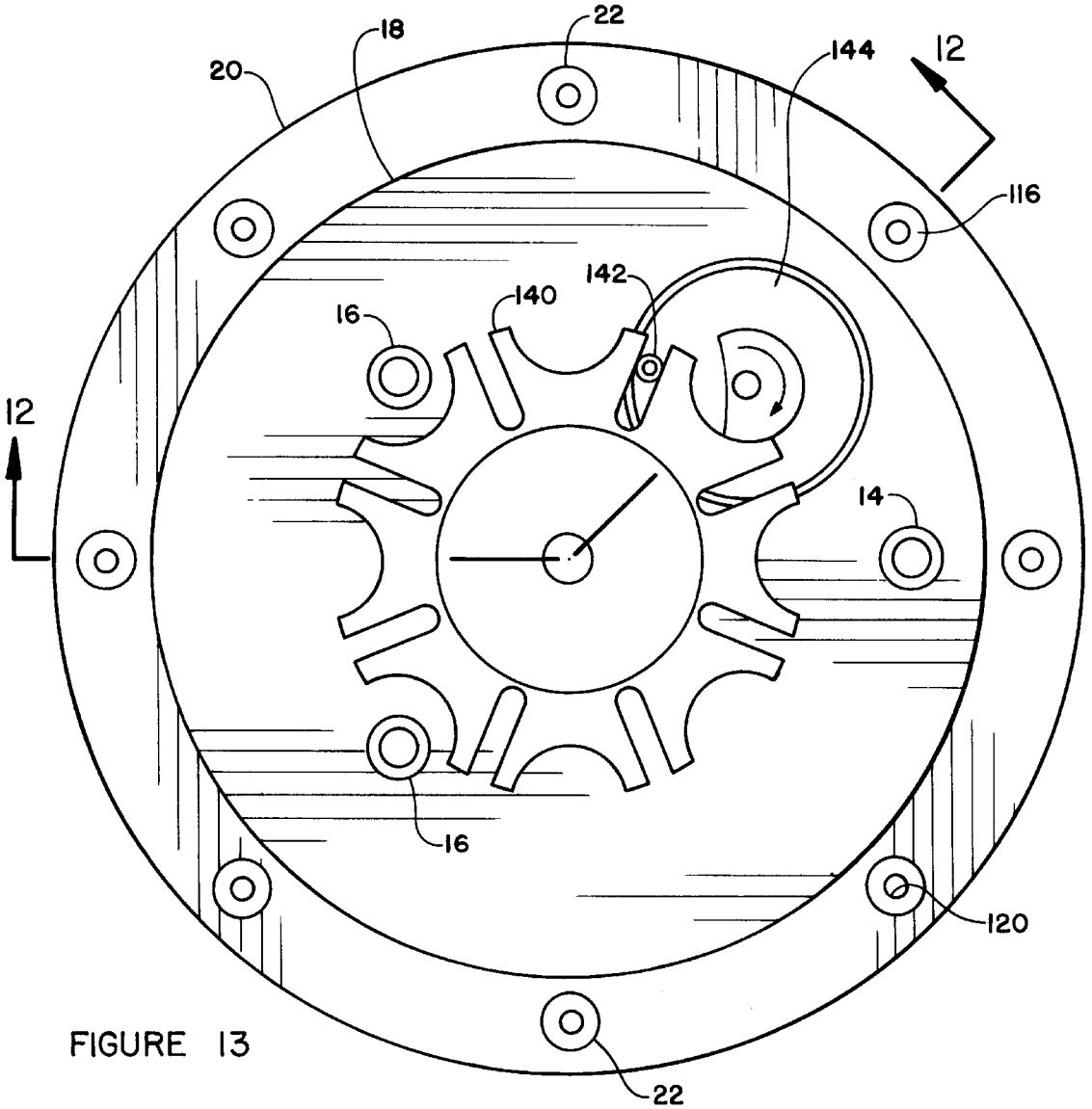
FIG. 13 is a top plan view, partially cut away, taken generally on line 13—13 in FIG. 12.

The mechanism for cycling a plurality of shafts 24 through the loading, painting, drying and removal steps is detailed in FIGS. 12 and 13.

Disk 20 is rotatably mounted on top plate 18 through flanged bushing 134, shaft 136 and bearings 138. A Geneva mechanism 140 secured to bushing 134 is rotated intermittently by pin 142 mounted on disk 144. Disk 144 is rotated by a conventional motor and belt (not shown) through pulley 146 to which the disk is secured. As disk 144 rotates, one gripper 22 and depending shaft 24 will be moved to the painting station and the Geneva mechanism will pause the rotation for a period sufficient for painting to be accomplished, then the rotation will be continued to bring the next shaft into painting position. Meanwhile, painted shafts will move with disk 20 to a removal and replacement station just upstream of the painting station. This will provide time for hardening of paint before removal as the painted shaft 24 moves around disk 20. With this system a number of shafts can be rapidly and accurately painted in sequence. With conventional programming, under microprocessor control, shafts having different tapers or steps along the shaft of the sort shown in FIG. 1 can be given very uniform paint coatings. Of course, if desired, the machine could be manually adjusted or could have mechanical systems such as cam sets to vary the size of hole 52 during painting to accommodate a particular shaft surface configuration.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. Apparatus for painting elongated thin shafts having proximal and distal ends which comprises:

gripping means for holding a proximal end of a shaft to be painted;

a paint head assembly movable along said shaft;

drive means for moving said paint head assembly between locations beyond a distal shaft end adjacent to said proximal shaft end;

support means for supporting said drive means on said apparatus;

flexible container means comprising a sheet of flexible material within said paint head assembly configured to hold a quantity of paint and having a central hole for surrounding said shaft;

expansion means for changing area of said hole between a first area where edges of said hole contact a shaft extending into said hole and a second larger area where said edges of said hole are spaced from shaft; and paint application means cooperating with said paint container means comprising a frame for holding said continuous outer edge for surrounding said hole and shaft at said hole with paint when said hole is in said first position and for separating said paint from said hole and shaft at said hole when said hole is in said second position;

means for moving said continuous outer edge between an upper position so that said sheet has a bowl-like configuration and a lower position so that said sheet has a trough like configuration;

whereby said paint head assembly can be moved to a predetermined first location adjacent to said distal shaft end with said hole in said second position, said hole moved to said first position, said paint head assembly moved along said shaft to a second predetermined location along said shaft and said hole moved to said second position, expanding said hole out of contact with said shaft and moving said paint head assembly beyond said distal shaft end.

2. The apparatus according to claim 1 further including means for stirring paint in held by said flexible means which comprises at least one irregularly shaped object of magnetically attractable material in said flexible container and means for moving at least one magnet along a surface of said flexible container opposite said object.

3. The apparatus according to claim 2 wherein said at least one magnet is mounted in a disk rotatable adjacent to said flexible container when said flexible container is in said trough-like configuration and further including means for rotating said disk.

4. The apparatus according to claim 1 wherein said frame is supported by a plurality of vertically movable posts and said apparatus further includes drive means for moving said posts upwardly and downwardly to move said frame between said raised and lowered positions.

5. The apparatus according to claim 1 further including means for supporting a plurality of shafts for sequential movement of said paint head assembly along said shafts, means for gripping one end of each shaft and means for intermittently moving said shafts from a station for removal of painted shafts and installation of shafts onto said support means, a painting station at which said paint head is moved along said shaft.

6. The apparatus according to claim 5 wherein said intermittent movement means comprises a powered Geneva mechanism.

7. The apparatus according to claim 1 wherein said shafts are tubular and said gripping means comprises a tube sized to fit within an end of said tubular shaft, a plurality of spaced plugs within said tube, a compression spring in contact with a plug, a ball having a diameter approximately corresponding internal diameter of said tube and slidable therein and a plurality of balls having smaller diameters, engaging a next plug surface and a plurality of holes through said tube, diameters of said holes being such as to permit said smaller diameter balls to project therethrough while retaining said smaller balls.

8. The apparatus according to claim 7 wherein said gripping means includes a head for receiving an end of said tube and for mounting said gripping means on a movable support means.

9. The apparatus according to claim 1 wherein said head includes a circular recess around said tube and spring means for engaging an exterior end of said shaft and releasably retaining said shaft.

10. A paint head assembly for painting elongated shafts which comprises:

a flexible container comprising a sheet of flexible material having an outer edge and a hole in a central region and configured to contain a quantity of paint;

expansion means for supporting said central region and for changing area of said hole between a first area where edges of said hole would contact a shaft extending into said hole and a second, larger, area where said edges of said hole would be spaced from said shaft;

a frame for supporting said outer edge of said sheet;

means for supporting said frame relative to said expansion means;

means for moving said frame between a raised position in which said flexible container has a generally bowl-like configuration so that a surface of any paint in said flexible container will be above said hole and a lowered position in which said flexible container has a circular trough-like configuration so that said hole is above said surface of any paint in said flexible container;

whereby, with said hole having said first area and said frame in said raised position, paint is uniformly applied to said shaft and, with said hole having said second area and said frame in said lowered position, said shaft can be removed from said hole.

11. The paint head assembly according to claim 10 further including means for stirring paint in held by said flexible means which comprises at least one irregularly shaped object of magnetically attractable material in said flexible container and means for moving at least one magnet along a surface of said flexible container opposite said object.

12. The apparatus according to claim 11 wherein said at least one magnet is mounted in a disk rotatable adjacent to said flexible container when said flexible container is in said trough-like configuration and further including means for rotating said disk.

13. The apparatus according to claim 10 wherein said frame is supported by a plurality of vertically movable posts and said apparatus further includes drive means for moving said posts upwardly and downwardly to move said frame between said raised and lowered positions.

14. The apparatus according to claim 10 wherein said expansion means comprises a plurality of tube segments, means for securing said segments to said flexible means around said hole and means for moving said tube segments away from each other to expand area of said hole and to move said tube segments toward each other to reduce said area of said hole.

15. The apparatus according to claim 14 wherein said means for moving said segments includes a cam follower means connected to each of said tube segments and rotatable cam means engaging said cam follower means, said cam means configured to move said tube segments away from each other when rotated in one direction and to move said tube segments toward each other when rotated in the opposite direction.

16. Apparatus for painting elongated thin shafts having proximal and distal ends which comprises:

gripping means for holding a proximal end of a shaft to be painted;

a paint head assembly movable along said shaft;

drive means for moving said paint head assembly between locations beyond a distal shaft end adjacent to said proximal shaft end support means for supporting said drive means on said apparatus;

flexible container means within said paint head assembly configured to hold a quantity of paint and having a central hole for surrounding said shaft;

expansion means comprising a plurality of tube segments for changing area of said hole between a first area where edges of said hole contact a shaft extending into said hole and a second larger area where said edges of said hole are spaced from shaft;

means for securing said tube segments to said flexible means around said hole;

means for moving said tube segments away from each other to expand hole area and toward each other to reduce hole area;

said means for moving said tube segments includes a cam follower means connected to each of said tube segments and rotatable cam means engaging said cam follower means, said cam means configured to move said tube segments away from each other when rotated in one direction and to move said tube segments toward each other when rotated in the opposite direction; and paint application means cooperating with said paint container means for surrounding said hole and shaft at said hole with paint when said hole is in said first position and for separating said paint from said hole and shaft at said hole when said hole is in said second position;

whereby said paint head assembly can be moved to a predetermined first location adjacent to said distal shaft end with said hole in said second position, said hole moved to said first position, said paint head assembly moved along said shaft to a second predetermined location along said shaft, said hole moved to said second position, expanding said hole out of contact with said shaft and moving said paint head assembly beyond said distal shaft end.

* * * * *